US006575803B1

(12) United States Patent
Liu

(10) Patent No.: US 6,575,803 B1
(45) Date of Patent: Jun. 10, 2003

(54) BUILT-UP CARD HOLDER

(76) Inventor: Kuo-Ching Liu, 5 Fl., No. 11, Alley 1, Lane 1, Sec. 1, Yungan s. Rd., Lujou City, Taipei (TW), 247

( * ) Notice: Subject to any disclaimer, the term of this patent is extended or adjusted under 35 U.S.C. 154(b) by 0 days.

(21) Appl. No.: 10/162,870

(22) Filed: Jun. 6, 2002

(51) Int. Cl.[7] ..... A63H 33/38

(52) U.S. Cl. ..... 446/147; 446/387; 446/85; 40/124.19

(58) Field of Search ..... 446/147, 148, 446/149, 150, 151, 152, 387, 85; 248/174, 441.1, 152; 40/124.19, 674, 538

(56) References Cited

U.S. PATENT DOCUMENTS

| | | | | | |
|---|---|---|---|---|---|
| 1,742,858 | A | * | 1/1930 | Heinz | 248/459 |
| 3,594,948 | A | * | 7/1971 | Luchsinger | 446/361 |
| 4,203,239 | A | * | 5/1980 | Williams et al. | 40/761 |
| 4,993,560 | A | * | 2/1991 | Jaffe | 211/45 |
| 5,042,760 | A | * | 8/1991 | Boschetto | 248/174 |
| 5,603,175 | A | * | 2/1997 | Brenner | 40/124.4 |
| 5,758,438 | A | * | 6/1998 | Miyata | 36/132 |
| 5,775,971 | A | * | 7/1998 | Brown | 446/376 |
| 5,983,538 | A | * | 11/1999 | Crowell | 40/124.14 |

FOREIGN PATENT DOCUMENTS

| | | | | |
|---|---|---|---|---|
| FR | 2278370 A | * | 3/1976 | A63F/9/06 |
| GB | 2101492 A | * | 1/1983 | A63H/33/16 |
| JP | 10324080 A | * | 12/1998 | B42D/15/02 |
| WO | WO 9732794 A1 | * | 9/1997 | B65D/69/00 |

* cited by examiner

*Primary Examiner*—Derris H. Banks
*Assistant Examiner*—Urszula M Cegielnik
(74) *Attorney, Agent, or Firm*—Rosenberg, Klein & Lee

(57) ABSTRACT

A card holder is built up with flat parts that are detachably contained in a board before being used to assemble the card holder. The board may be made of a plastic material or a cardboard and is stamped with dies to provide the parts. The parts are then detached from the board to build up the card holder. The board with the parts removed therefrom is used as a base of the card holder, and two generally Y-shaped parts are vertically inserted into two slots provided on the base to serve as two supports for holding a plurality of cards in two deep openings thereon. Other parts may be assembled into decorative models for vertically inserting on the base to also act as a counterbalance to the cards held in the two supports.

4 Claims, 4 Drawing Sheets

BUILT-UP CARD HOLDER

FIELD OF THE INVENTION

The present invention relates to a built-up card holder, and more particularly to a card holder built up with parts that are included in a board before being used to assemble the card holder.

BACKGROUND OF THE INVENTION

There are various kinds of built-up toys. The most common designs for built-up toys include model animals, such as model dinosaurs, model animal skeletons, and toy furniture. These toys are built up with a plurality of flat parts that, before being assembled, are formed on a board by stamping the board with dies. The stamped parts may be detached from the board at any time and assembled into an intended model or toy.

The conventional built-up toys are used only as ornaments without any other function. It is therefore desirable to develop functional built-up items, such as a built-up card holder for conveniently holding cards thereon.

SUMMARY OF THE INVENTION

A primary object of the present invention is to provide a built-up card holder that includes two generally Y-shaped parts as supports for vertically inserting on a base of the card holder to hold a plurality of cards.

Another object of the present invention is to provide a built-up card holder that includes a built-up model toy vertically inserted on a base of the card holder to act as a decoration and a counterbalance to cards held in a pair of card supports on the card holder.

A further object of the present invention is to provide a built-up card holder that includes a built-up model or toy that can be removed from the card holder to serve as an independent ornament.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
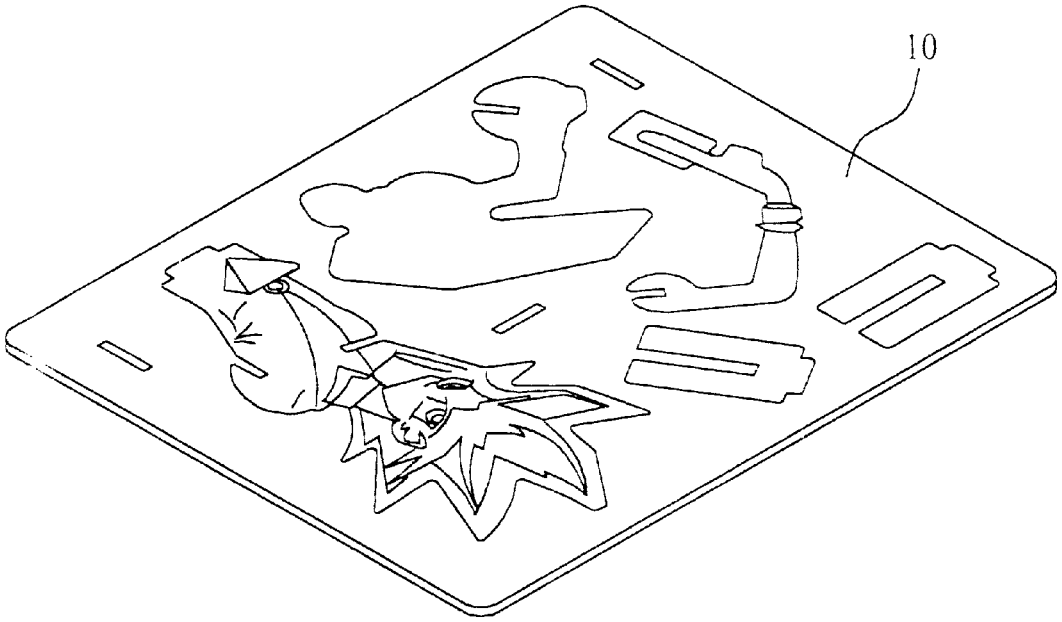
FIG. 1 shows a board that contains parts for building up a card holder of the present invention.

Please refer to FIG. 1 in which a board 10 containing parts for forming a built-up card holder of the present invention is shown. In other words, parts for building up the card holder of the present invention are contained in the board 10 before being used to assemble the card holder. The board 10 may be made of a rigid plastic material or a hard cardboard and is stamped with dies at one side, such that the parts for building up the card holder are formed on and detachably connected to the board 10.

Figure 2:
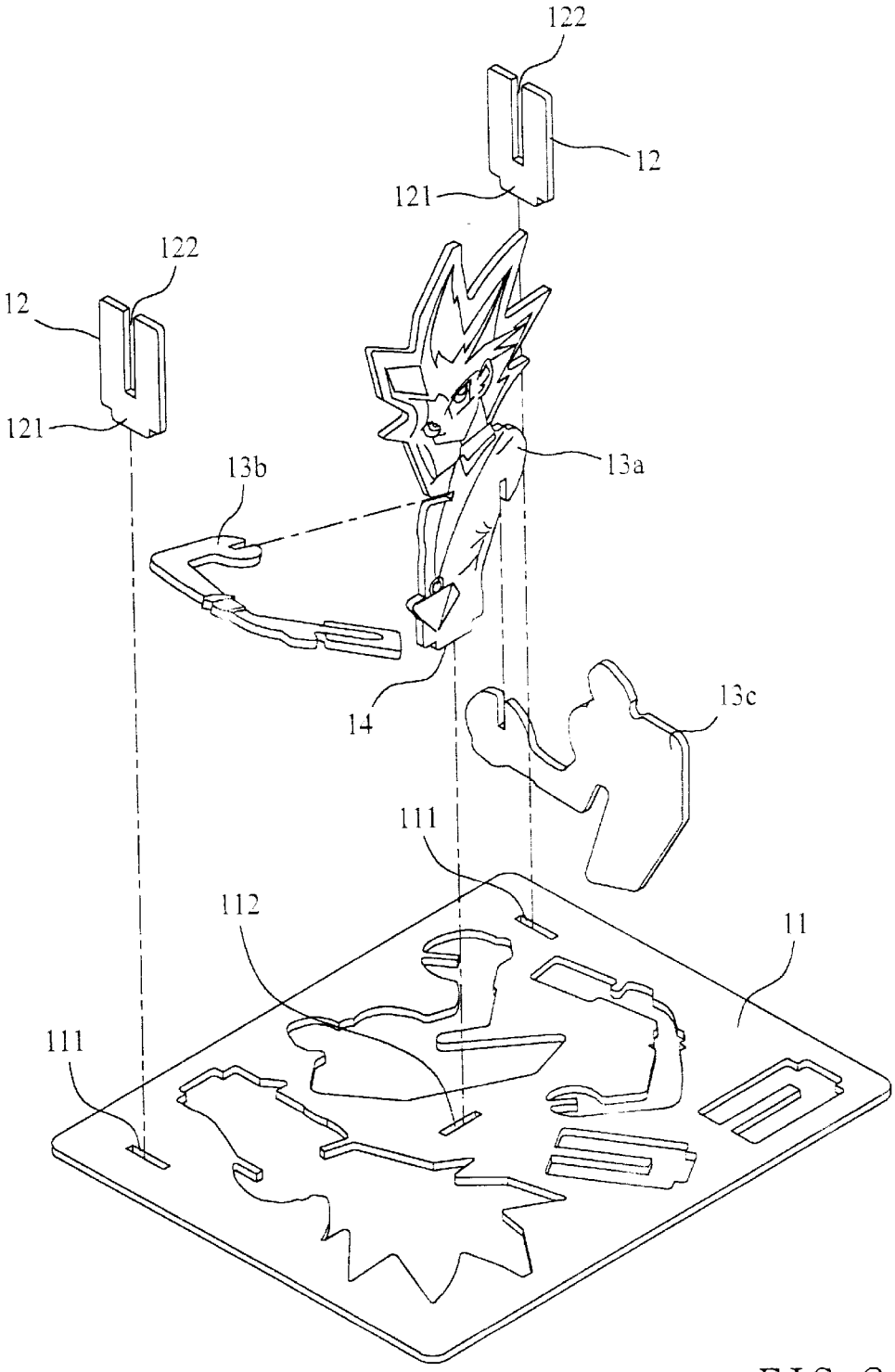
FIG. 2 shows parts for building up the card holder of the present invention are detached from the board of FIG. 1.
Figure 3:
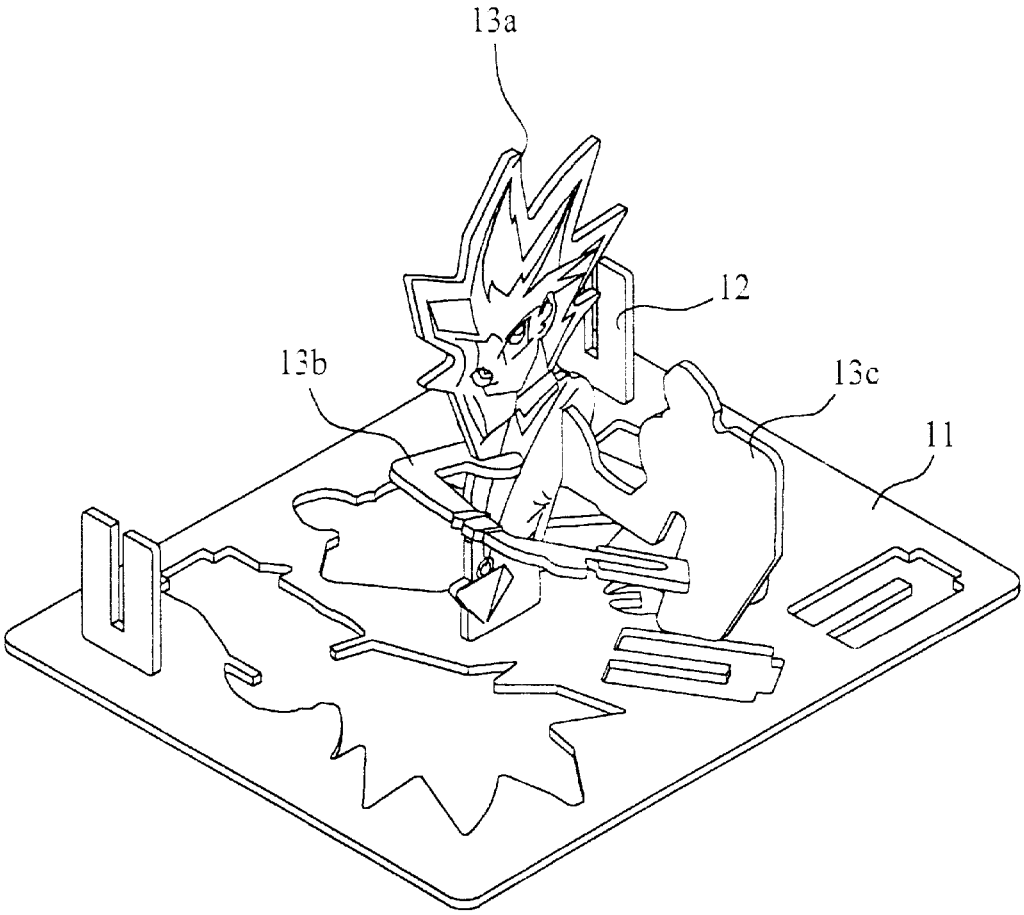
FIG. 3 shows parts detached from the board of FIG. 1 are connected to the board in a predetermined manner to form the built-up card holder of the present invention.

Please refer to FIGS. 2 and 3. The board 10 serves as a base 11 after the parts for forming the built-up card holder of the present invention are detached therefrom. In the illustrated embodiment, the parts for forming the card holder of the present invention include at least a pair of generally Y-shaped supports 12, each of which having an insert portion 121 downward extended from a bottom thereof and defining a deep opening 122 in an upper body portion thereof. The two Y-shaped supports 12 are firmly vertically assembled to a top of the base 11 by inserting the two insert portions 121 into two slots 111 correspondingly provided on the board 10. It is preferable the insert portions 121 could be fully received in the slots 111 after they are inserted thereinto, as shown in FIG. 3.

The parts formed on the board 10 also include other designs for building up, for example, some specific model figure. In the illustrated embodiment, the parts on the board 10 also include a model trunk 13*a* and two model arms 13*b*, 13*c* for a "King of Game". The model trunk 13*a* has an insert portion 14 downward extended from a bottom thereof for inserting into a slot 112 provided near a center of the base 11, so that the King of Game may stand upright on the base 11.

Figure 4:
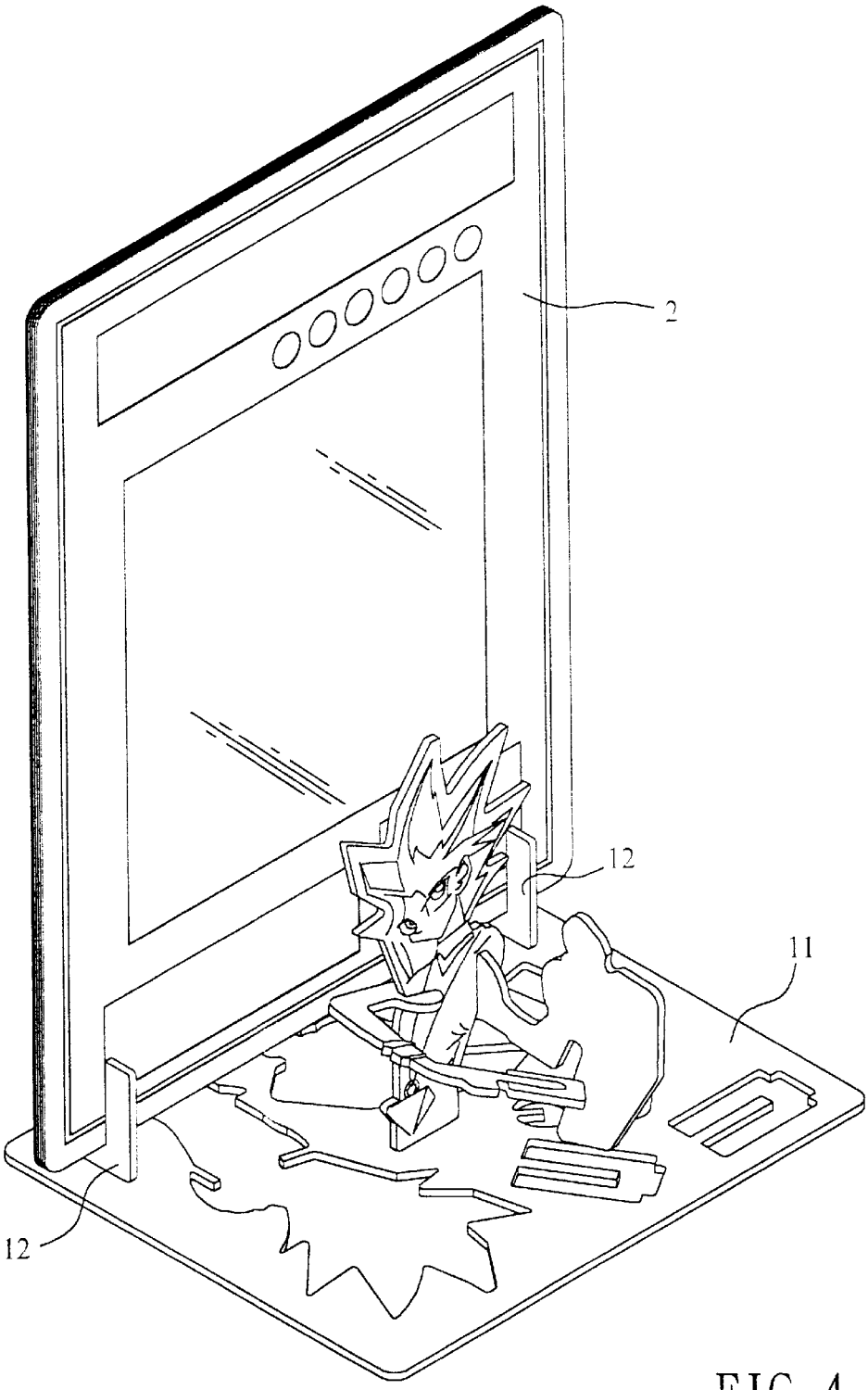
FIG. 4 shows the built-up card holder of the present invention is used to hold cards.

FIG. 4 shows a completed card holder of the present invention is used to hold cards. The two Y-shaped supports 12 are symmetrically and oppositely erected on the base 11, so that a plurality of cards 2 may be vertically positioned in the deep openings 122 on the two supports 12.

The model figure may be of any design to serve as a detachable decoration on the built-up cardholder. The model figure also serves to balance the whole card holder for the latter to stand stably without easily tilting over.

The card holder of the present invention is built up from simple flat parts that are contained in a flat board before being used to assemble the card holder and therefore occupy only a very small volume. Therefore, the present invention may be easily packaged for selling alone or along with other merchandises.

What is claimed is:

1. A built-up card holder, comprising:

a base in the form of a flat board having two symmetric and opposite first slots provided at predetermined positions thereon; and at least one pair of generally Y-shaped supports in the form of flat parts, each of said Y-shaped supports defining a deep opening in an upper body portion thereof and having an insert portion downward extended from a bottom thereof;

said insert portions of said Y-shaped supports being adapted to insert into said first slots on said base for said Y-shaped supports to stand upright and opposite to each other, and said deep openings on said Y-shaped supports being adapted to hold a plurality of cards therein; and said base and said Y-shaped supports being contained in the same one board before they are used to assemble said card holder.

2. The built-up card holder as claimed in claim 1, wherein said base is provided at a predetermined position with a second slot, into which a model figure is vertically inserted to stand upright on said base; said model figure being built up with model parts and having an insert portion downward extended from a bottom thereof for inserting into said second slot on said base, so that said model figure acts as a counterbalance to cards held in said Y-shaped supports.

3. The built-up card holder as claimed in claim 2, wherein said model parts for forming said model figure are contained in said board containing said base and said Y-shaped supports.

4. The built-up card holder as claimed in claim 1, wherein said insert portions of said Y-shaped supports are fully received in said first slots on said base after being inserted thereinto.

* * * * *